US005295934A

United States Patent [19]

Collins et al.

[11] Patent Number: 5,295,934

[45] Date of Patent: Mar. 22, 1994

[54] BARBELL COLLAR APPARATUS

[76] Inventors: Christopher H. Collins; Matthew M. Collins, both of 442 Kenwood Ave., Delmar, N.Y. 12054

[21] Appl. No.: 12,769

[22] Filed: Feb. 3, 1993

[51] Int. Cl.[5] ..... A63B 13/00

[52] U.S. Cl. ..... 482/107; 482/108

[58] Field of Search ..... 482/104–108; 403/344, 261, 321, 325–327; 285/1, 26, 80, 33, 163, 261, 268, 269, 166, 167

[56] References Cited

U.S. PATENT DOCUMENTS

| | | | |
|---|---|---|---|
| 1,179,594 | 10/1916 | Hall | 482/107 |
| 2,640,696 | 6/1953 | Lemieux | 482/107 |
| 2,796,269 | 6/1957 | Watson | 482/107 |
| 4,579,337 | 4/1986 | Uyeda | 482/107 |
| 4,638,994 | 1/1987 | Gogarty | 482/107 |
| 4,738,446 | 4/1988 | Miles | 482/107 |
| 4,773,641 | 9/1988 | Metz | 482/107 |
| 4,787,629 | 11/1988 | DeMyer | 482/107 |
| 4,893,810 | 1/1990 | Lee | 482/107 |
| 5,163,887 | 11/1992 | Hatch | 482/107 |

*Primary Examiner*—Richard J. Apley
*Assistant Examiner*—Jerome Donnelly
*Attorney, Agent, or Firm*—Leon Gilden

[57] ABSTRACT

A barbell collar includes a collar and sleeve arrangement that are telescopingly displaceable relative to one another to permit adjustment along a barbell support rod. Retractable detent spheres are mounted within the sleeve for engagement with annular grooves of the barbell to effect selective securement and positioning of the sleeve structure relative to the barbell rod.

6 Claims, 6 Drawing Sheets

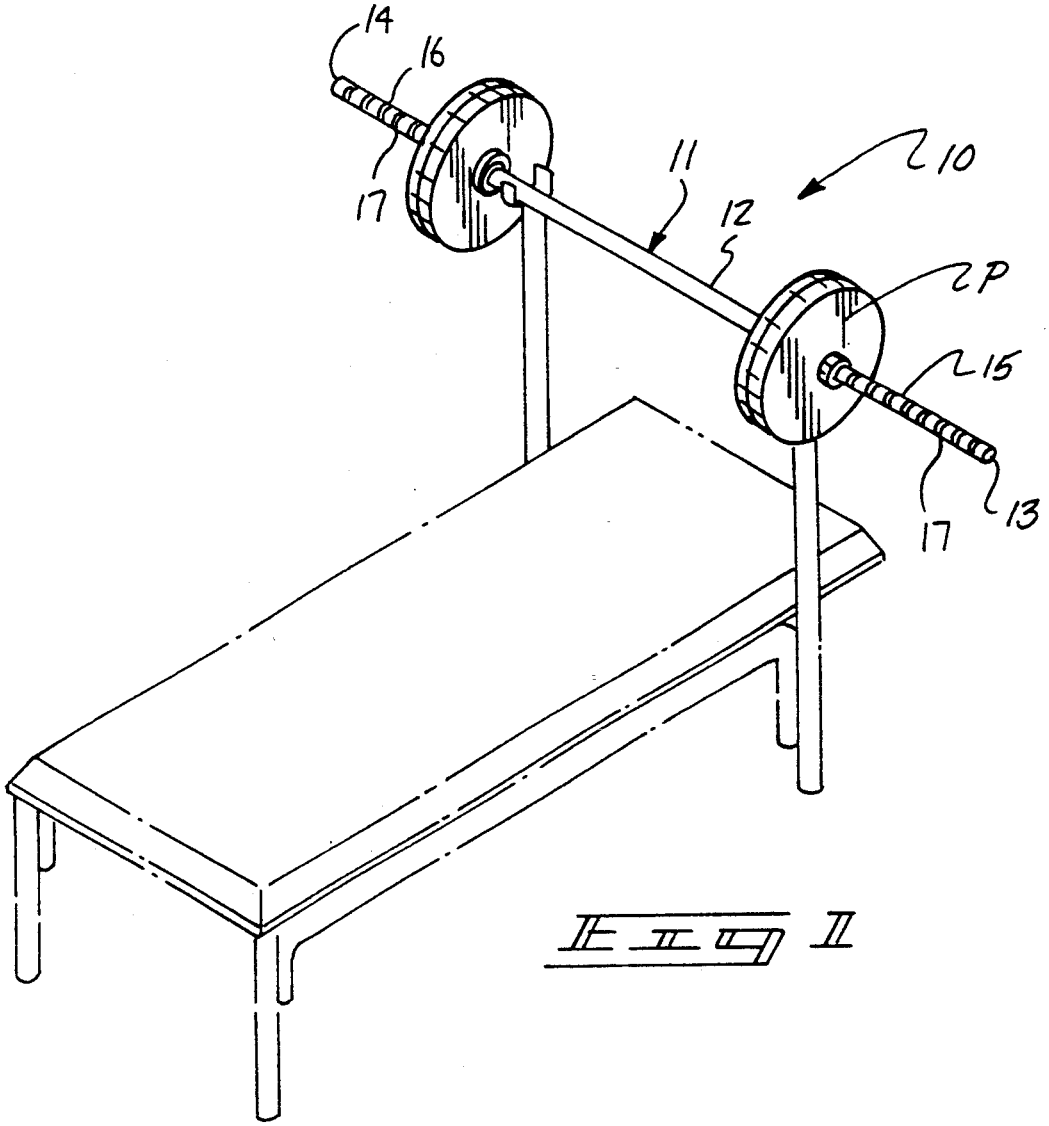
FIG 1
FIG 2
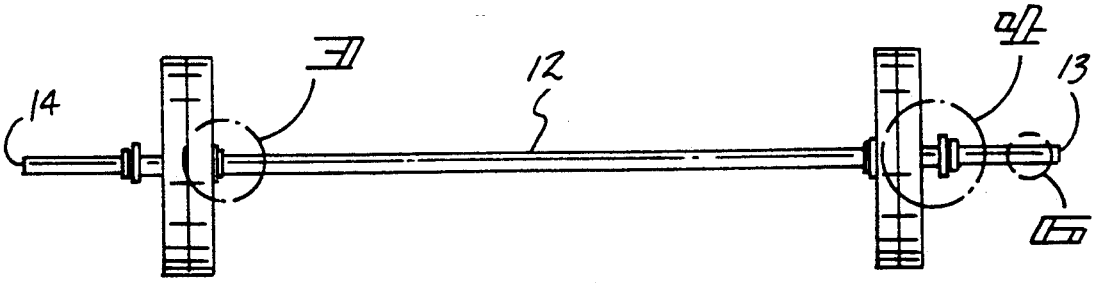

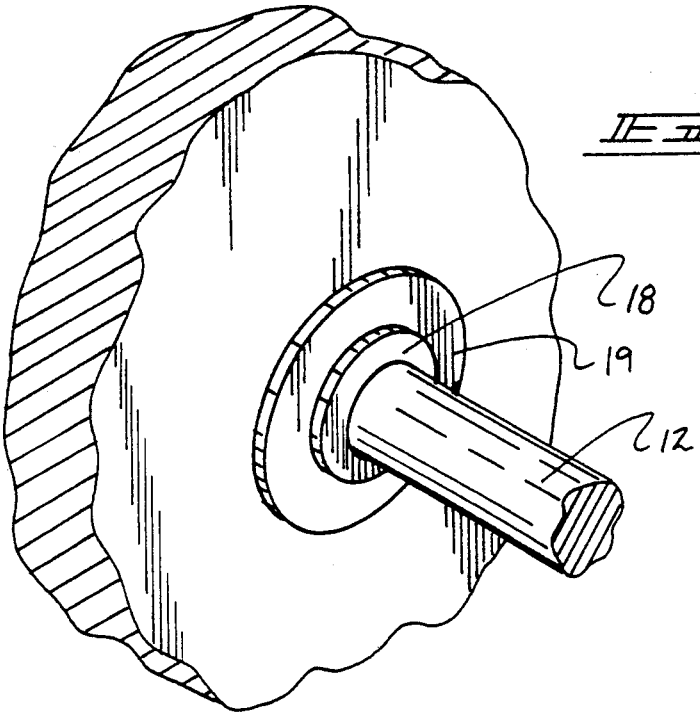
FIG 3
FIG 4
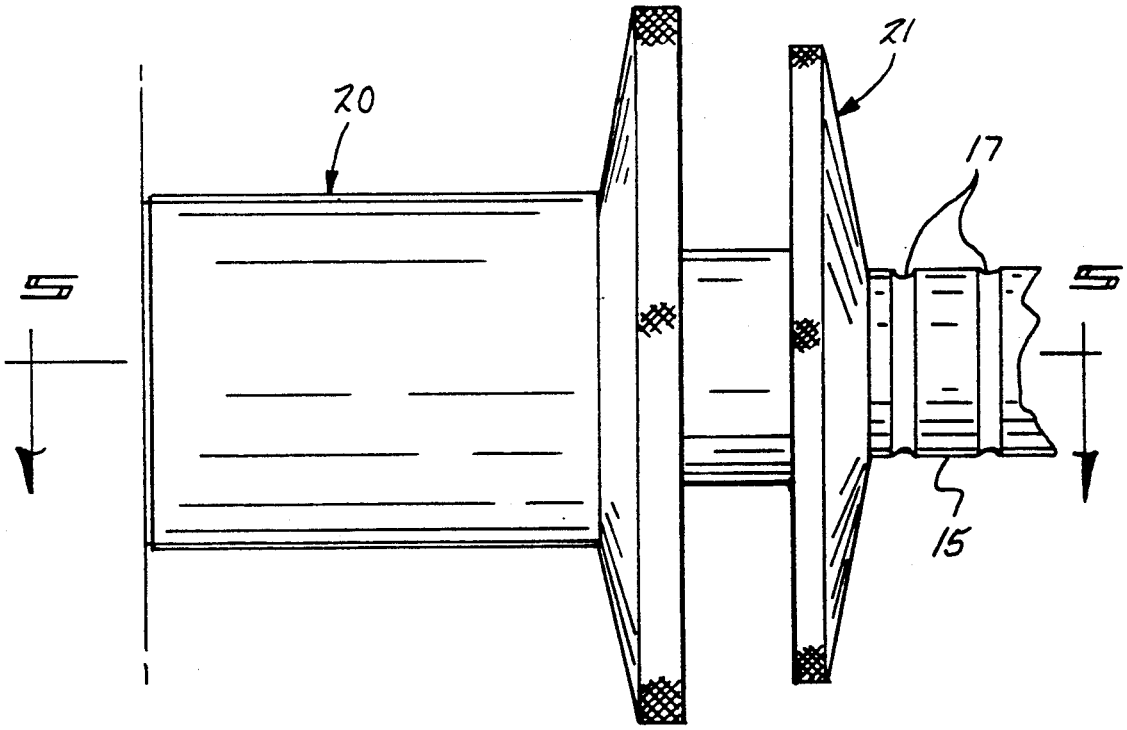

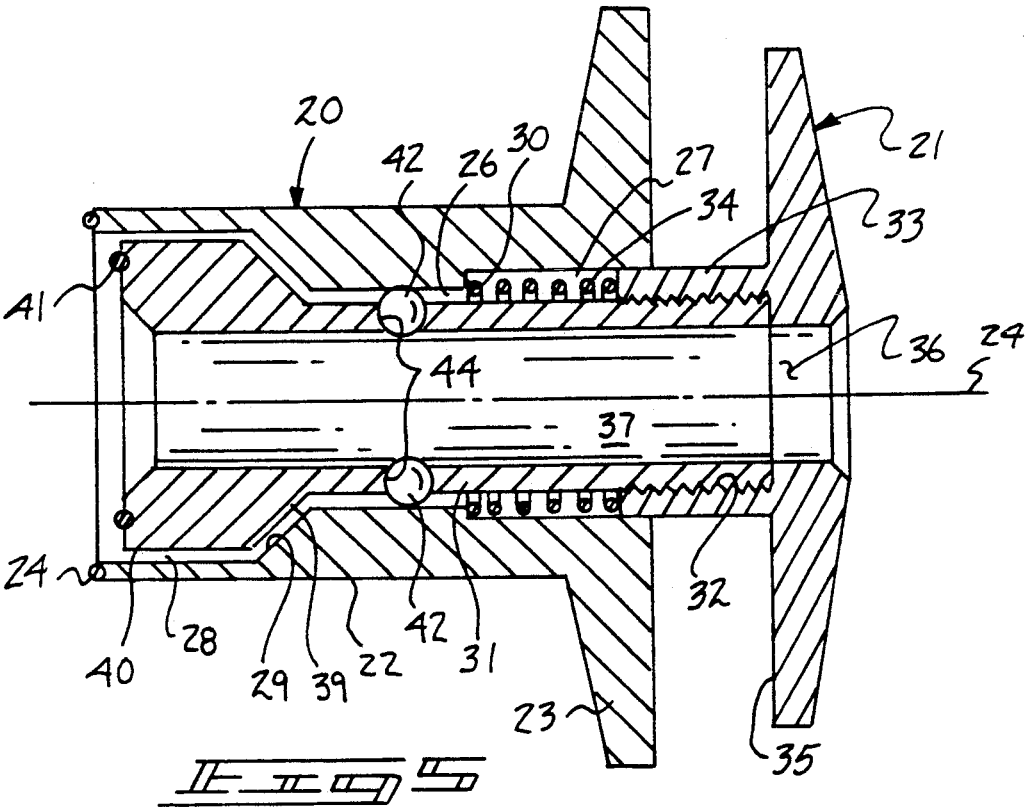
FIG 5
FIG 6
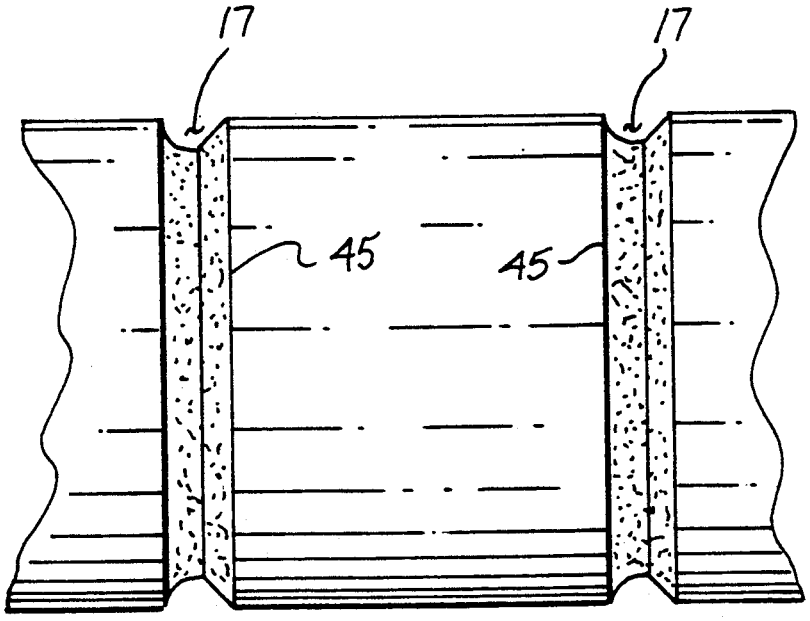

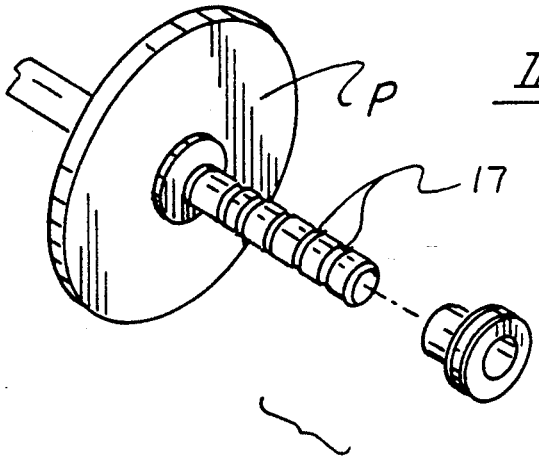
Fig 9
Fig 11
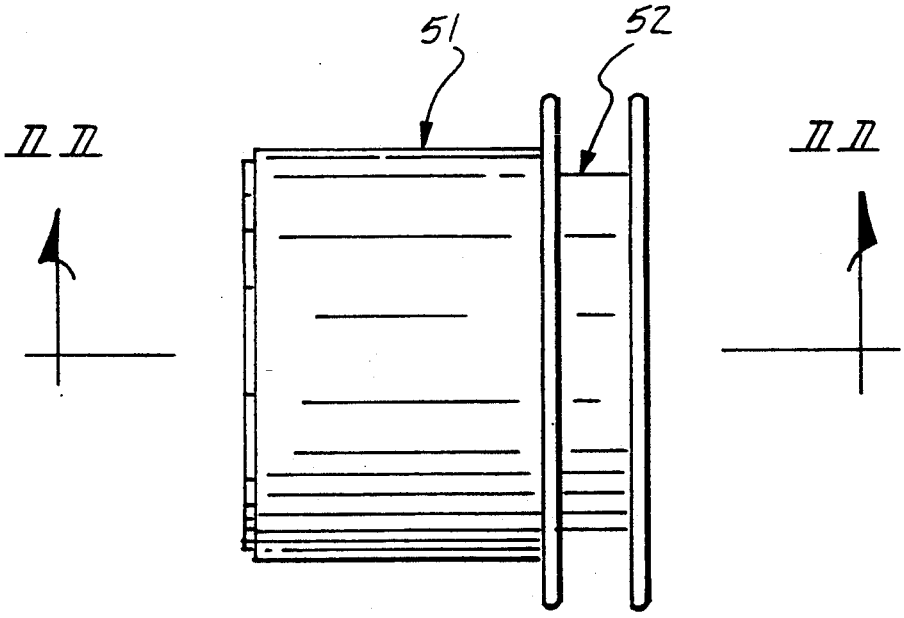

BARBELL COLLAR APPARATUS

BACKGROUND OF THE INVENTION

1. Field of the Invention

The field of invention relates to exercise apparatus, and more particularly pertains to a new and improved barbell collar apparatus wherein the same is arranged for the securement of a barbell weighted plate structure relative to a barbell cylinder.

2. Description of the Prior Art

Barbell collars of various types have been utilized throughout the prior art for securing barbells to an associated rod, as indicated in U.S. Pat. Nos. 4,955,603; 5,062,631; and 4,639,979.

The instant invention attempts to overcome deficiencies of the prior art by providing for a quick-release and securement of the collar structure relative to a barbell in a manner addressing ease of use as well as effectiveness in construction and in this respect, the present invention substantially fulfills this need.

SUMMARY OF THE INVENTION

In view of the foregoing disadvantages inherent in the known types of barbell apparatus now present in the prior art, the present invention provides a barbell collar apparatus wherein the same is arranged for the securement of plate members relative to an associated barbell rod. As such, the general purpose of the present invention, which will be described subsequently in greater detail, is to provide a new and improved barbell collar apparatus which has all the advantages of the prior art barbell apparatus and none of the disadvantages.

To attain this, the present invention provides a barbell collar including a collar and sleeve arrangement that are telescopingly displaceable relative to one another to permit adjustment along a barbell support rod. Retractable detent spheres are mounted within the sleeve for engagement with annular grooves of the barbell to effect selective securement and positioning of the sleeve structure relative to the barbell rod.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved barbell collar apparatus which has all the advantages of the prior art barbell apparatus and none of the disadvantages.

It is another object of the present invention to provide a new and improved barbell collar apparatus which may be easily and efficiently manufactured and marketed.

It is a further object of the present invention to provide a new and improved barbell collar apparatus which is of a durable and reliable construction.

An even further object of the present invention is to provide a new and improved barbell collar apparatus which is susceptible of a low cost of manufacture with regard to both materials and labor, and which accordingly is then susceptible of low prices of sale to the consuming public, thereby making such barbell collar apparatus economically available to the buying public.

Still yet another object of the present invention is to provide a new and improved barbell collar apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention in use.

FIG. 2 is an orthographic view of the assembled barbell collar structure.

FIG. 3 is an enlarged isometric illustration of section 3 as set forth in FIG. 2.

FIG. 4 is an orthographic view, somewhat enlarged, of section 4 as set forth in FIG. 2.

FIG. 5 is an orthographic view, taken along the lines 5—5 of FIG. 4 in the direction indicated by the arrows.

FIG. 6 is an enlarged orthographic view of section 6 as set forth in FIG. 2.

FIG. 9 is an isometric illustration of a modified collar structure.

FIG. 10 is an orthographic side view of the collar structure as utilized in FIG. 9.

DESCRIPTION OF THE PREFERRED EMBODIMENT

Figure 7:
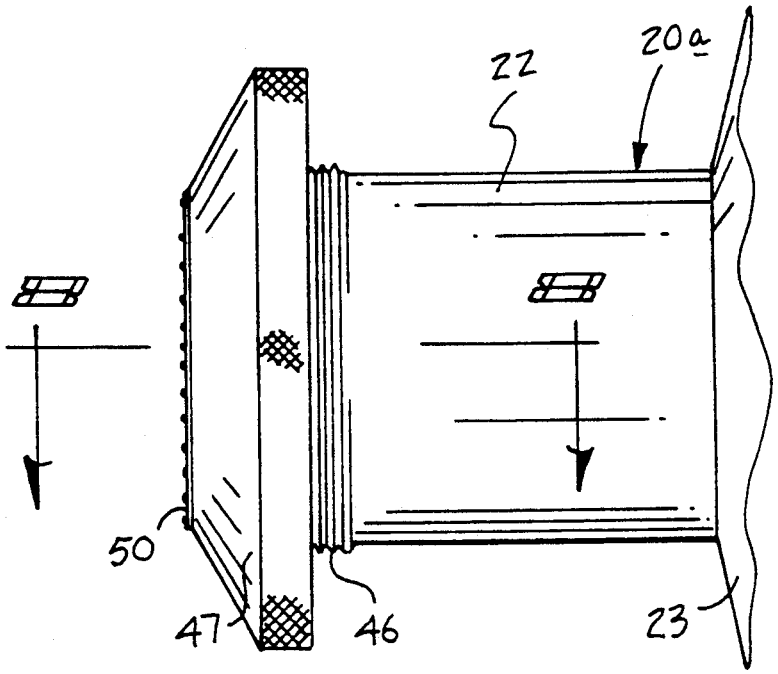
FIG. 7 is an orthographic view of a modified collar member as employed by the invention.

With reference now to the drawings, and in particular to FIGS. 1 to 12 thereof, a new and improved barbell collar apparatus embodying the principles and concepts of the present invention and generally designated by the reference numeral 10 will be described.

More specifically, the barbell collar apparatus 10 of the instant invention essentially comprises a cylindrical bar 11, having a central portion 12 and respective first and second ends 13 and 14, with first and second end portions 15 and 16 extending between the central portion 12 and respective first and second ends 13 and 14. The first and second end portions 15 and 16 each include spaced parallel grooves 17, of a type as indicated in the FIGS. 1 and 4 for example. Mounted to each end of the central portion 12 is an abutment ring 18 for engagement with plate members "P", as indicated in FIG. 1, wherein interposed between each abutment ring 18 is a resilient disc 19 between each abutment ring 18 and each respective first and second end portion 15 and 16 to frictionally engage the plates "P".

A collar member 20 telescopingly and slidingly receives a sleeve member 21, in a manner as indicated in the FIGS. 4 and 5. The collar member includes a cylindrical collar housing 22, having an abutment flange 23 orthogonally mounted to a collar axis 24 that the collar member 20 and the sleeve 21 are symmetrically oriented about. The abutment flange orthogonally oriented relative to the axis 24 is mounted to a first end of the collar housing 22, with an annular resilient collar housing "O" ring 25 mounted at a second end of the collar housing 22. The collar housing 22 includes a first bore 26 of a first diameter spaced intermediate the first and second ends of the collar housing 22, with the first bore symmetrically oriented about the axis 24. A second bore 27 extends from the first bore 26 to the first end of the collar housing, and is of a second diameter greater than the first diameter. A third bore 28 extends from the first bore 26 to the second end of the collar housing and is of a third diameter greater than the second diameter. A conical transition wall 29 extends from the first bore 26 to the third bore 28. An annular spring flange 30 orthogonally oriented relative to the axis 24 is formed at an intersection of the first and second bores 26 and 27 respectively for providing an abutment ledge for a spring member 34.

The sleeve member 21 includes a cylindrical sleeve central portion 31 slidably received through the first and second bores 26 and 27 and extending from the first end of the collar housing into the collar housing. An externally threaded first end portion 32 that extends to the first end of the sleeve 21 has an internally threaded abutment cylinder 33 rotatably mounted thereabout, with the spring member 34 interposed between the abutment cylinder 33 and the spring flange 30. An abutment cylinder annular flange 35 orthogonally oriented relative to the axis 24 is mounted to the abutment cylinder 33 in a spaced orientation relative to the abutment flange 23. An annular flange bore 36 directed through the annular flange is coaxially aligned with a sleeve member bore 37 directed through the sleeve member 21. A conical transition hub 39 extends from the cylindrical sleeve central portion 31 to a second end of the sleeve member 21 for engagement with the conical transition wall 29 of the collar member 20. A cylindrical tail stock 40 extends from the hub 39 and is arranged for sliding reception within the third bore 28. A sleeve member second end "O" ring 41 is mounted in the second end of the sleeve member 21. The "O" rings 24 and 41 are arranged for frictional engagement with plate members "P".

An annular array of spherical detents 42 are directed through the central portion 31 and have a predetermined detent diameter each received within a respective detent aperture 44, wherein the detent apertures 44 are less than the detent diameters of the detents 42. In this manner, displacement of the spherical detents 42 from the first bore 26 to the third bore 28 permits disengagement of and retraction from the sleeve member bore 37 to thereby permit projection and sliding reception of the cylindrical bar 11 therethrough. Upon proper orientation about the bar, the spring member 34 permits projection of the sleeve member 21 relative to the collar member 20 and engagement of the detents 42 within one of the annular groove 17. The annular grooves further are formed with a roughened surface 45, having random projections coextensive within each groove to provide for enhanced engagement of the detents within each groove.

Figure 8:
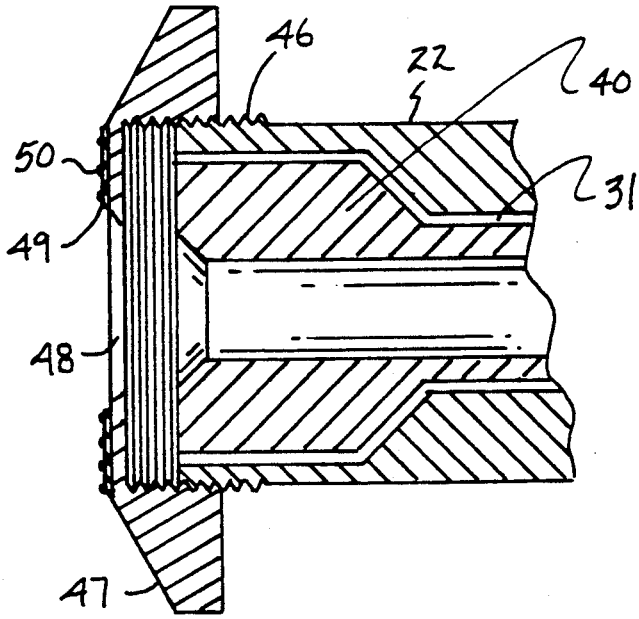
FIG. 8 is an orthographic view, taken along the lines 8—8 of FIG. 7 in the direction indicated by the arrows.
Figure 11:
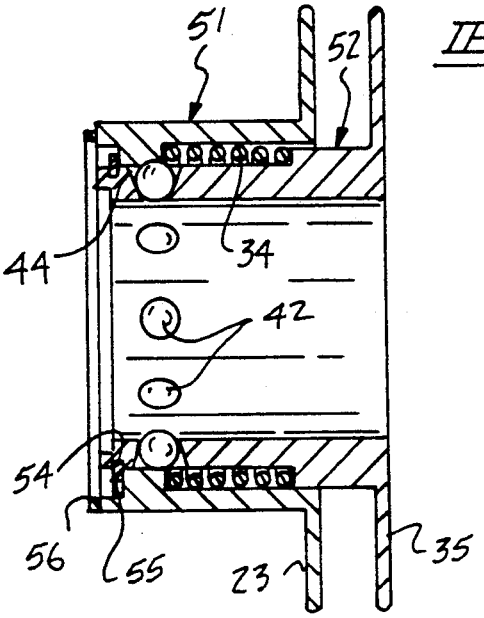
FIG. 11 is an orthographic cross-sectional illustration of section 11 as set forth in FIG. 10.
Figure 12:
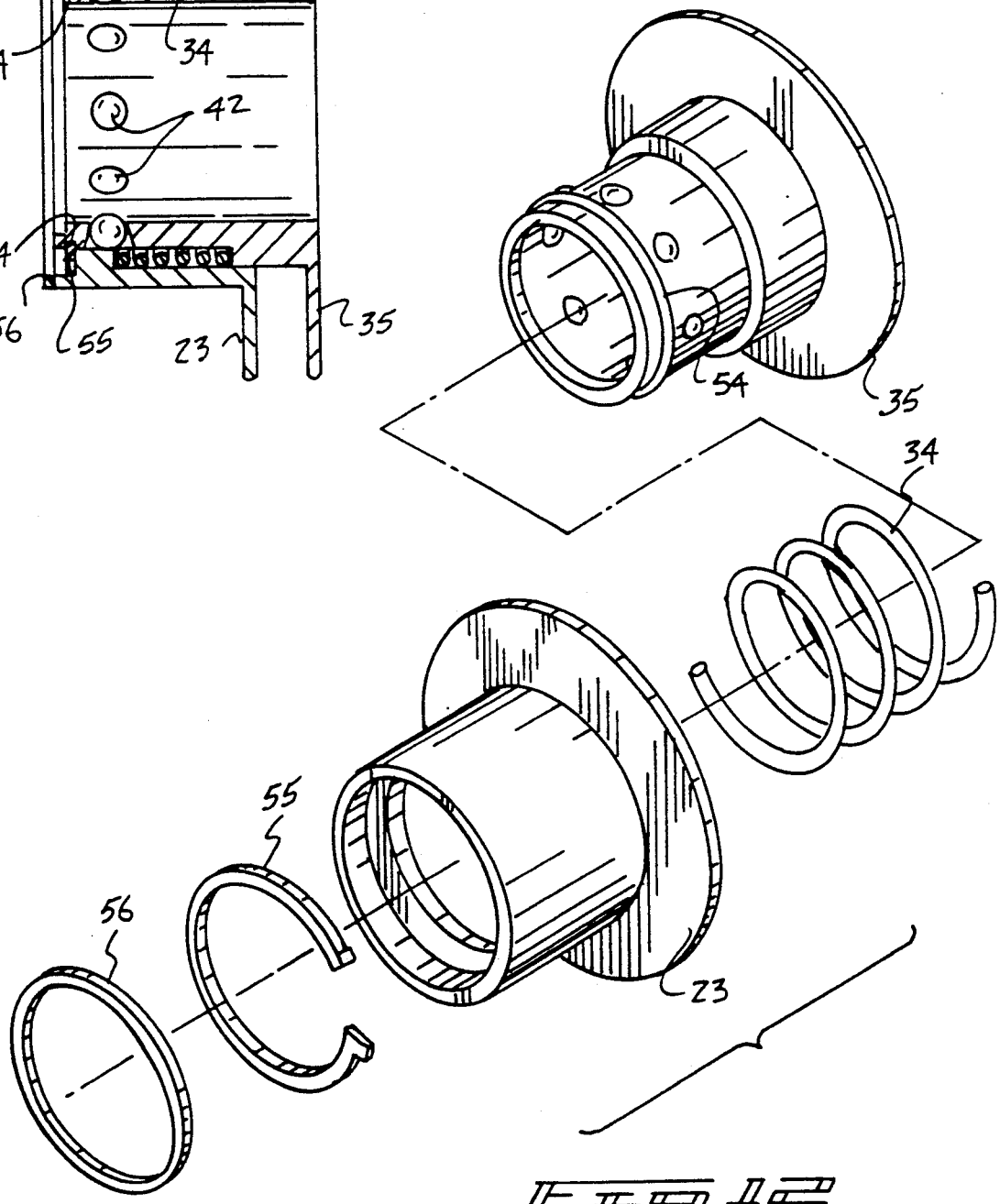
FIG. 12 is an isometric exploded illustration of the collar structure as indicated in FIG. 10.

A modified collar member 28*a*, as indicated in FIGS. 7 and 8, includes a collar housing externally threaded portion 46 extending to the second end of the collar housing, with an end flange 47 having an end flange bore 48, including an internally threaded portion arranged for engagement with the externally threaded portion 46 to provide for an abutment surface 49, having an abutment surface resilient laminate 50 for engagement with the plates "P". In this manner, fine adjustment of the organization is provided to provide for secure positioning of the plates "P" against the resilient disc 19.

The FIGS. 9–12 indicates the use of the outer sleeve structure 51 having an inner sleeve structure 52, wherein the inner sleeve includes the abutment flange 23 spaced from the abutment cylinder annular flange 35, with the spring 34 interposed between the outer sleeve and the inner sleeve, wherein a snap ring 54 mounted to an exterior surface of the inner sleeve prevents displacement of the inner sleeve 52 relative to the outer sleeve 51 as the snap ring is arranged for engagement with the outer sleeve interior surface, as indicated. An annular resilient gasket 56 is mounted to the outer sleeve second end, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A barbell collar apparatus, comprising, a cylindrical bar, the cylindrical bar having a central portion and a first end spaced from a second end, and a first end portion extending from the central portion to the first end, and a second end portion extending from the central portion to the second end, and a collar member and a sleeve mounted upon the first end portion and the second end portion for selective engagement with the first end portion and the second end portion, wherein each collar member telescopingly receives the sleeve, and wherein the collar member includes a cylindrical collar housing, the cylindrical collar housing having a housing first end and a housing second end, and an abutment flange mounted to the housing first end, and a collar housing resilient "O" ring mounted to the collar housing second end, and the collar housing sleeves symmetrically oriented about a collar axis, and detent means mounted within each sleeve for selective engagement of said cylindrical bar end a first bore having a first diameter spaced between the housing first end and the housing second end, and a second bore having a second diameter greater than the first diameter extending from the first bore to the housing first end, and a third bore extending from the first bore to the housing second end, having a third diameter greater than the second diameter, and a conical transition wall extending from the first bore to the third bore, and an annular spring flange orthogonally oriented relative to the axis positioned at an intersection of the first bore and the second bore, with the sleeve member having a cylindrical sleeve central portion slidably received through the first bore and the second bore, and the sleeve central portion having an externally threaded first end portion extending to a sleeve first end, and an internally threaded abutment cylinder threadely mounted about the externally threaded first end portion, with a spring member interposed between abutment cylinder and the spring flange, and an abutment cylinder annular flange mounted to the abutment cylinder extending laterally thereof, wherein the abutment cylinder annular flange is orthogonally oriented relative to the axis and spaced from the abutment flange of the collar member, and a sleeve member bore directed coextensively through the sleeve member to receive the cylindrical bar therethrough.

2. An apparatus as set forth in claim 1 wherein a conical transition hub is integral with the sleeve member extending from and projecting exteriorly of the sleeve central portion, with a cylindrical tail stock extending from the conical transition hub mounted with and received slidably through the third bore, with the conical transition hub arranged for engagement with and in spaced adjacency to the conical transition wall, and the detent means includes an annular array of spherical detents mounted within the sleeve central portion, with each of said spherical detents received within a detent aperture, wherein the detent aperture has an aperture diameter and each of the detents includes a detent diameter, and the detent diameter is greater than the aperture diameter, and each of the detents are captured between the sleeve central portion and the first bore for rotation along the first bore and the conical transition wall to permit displacement of the detents from the sleeve member bore to receive the cylindrical bar therethrough.

3. An apparatus as set forth in claim 2 wherein the first end portion and the second end portion of the cylindrical bar each include a plurality of spaced annular grooves, each of the annular grooves is arranged to receive the detents therewithin for selective positioning of the collar member and sleeve member along the cylindrical bar.

4. An apparatus as set forth in claim 3 wherein each of the grooves includes a roughened surface having a random array of projections to enhance engagement with the detents.

5. An apparatus as set forth in claim 4 wherein the collar housing includes a collar housing externally threaded portion extending along the collar housing to the housing second end, and end flange, the end flange having a bore, the bore having a bore internally threaded surface, with the bore internally threaded surface arranged for receiving the collar housing externally threaded portion to permit projection of the end flange for engagement with plate members captured between the end flange and the bar central portion.

6. An apparatus as set forth in claim 5 wherein the bar central portion includes a portion first end and a portion second end, with the portion first end and the portion second end each including an abutment ring fixedly mounted to the bar first end and the bar second end, and each abutment ring includes a resilient disc for engagement with the plate members.

* * * * *